US005594960A

United States Patent [19]

Stern

[11] Patent Number: 5,594,960

[45] Date of Patent: Jan. 21, 1997

[54] SWIMMING POOL COVER WITH DRAINAGE AND FILTER

[76] Inventor: Robert Stern, 1746 Lakewood Rd., Toms River, N.J. 08755

[21] Appl. No.: 575,736

[22] Filed: Dec. 18, 1995

[51] Int. Cl.[6] ..... E04H 4/10

[52] U.S. Cl. ..... 4/498; 4/496; 4/503

[58] Field of Search ..... 4/494, 496, 498, 4/500, 503; 210/257.1, 257.2; 150/154

[56] References Cited

U.S. PATENT DOCUMENTS 3,184,764 5/1965 West ..... 4/498
3,579,657 5/1971 Gurrieri ..... 4/512
4,028,750 6/1977 Gustafsson ..... 4/498
4,233,695 11/1980 Rowney ..... 4/498
5,259,078 11/1993 Crandall ..... 4/503

*Primary Examiner*—Henry J. Recla
*Assistant Examiner*—Charles R. Eloshway
*Attorney, Agent, or Firm*—Clifford G. Frayne

[57] ABSTRACT

A cover for a water pool comprised of flexible waterproof material having a drainage opening positioned therein and a sleeve defining a passageway secured on the cover and in alignment with and intersecting the drainage opening allowing a filter to be slidably positionable therein for filtering of rain water and melting snow to remove particulate matter, the filter repositionable or removable for cleaning without the need for removing the cover for the water pool.

18 Claims, 10 Drawing Sheets

SWIMMING POOL COVER WITH DRAINAGE AND FILTER

BACKGROUND OF THE INVENTION

1. Field of the Invention

The present invention relates to covers for swimming pools and fish ponds and similar water pools and, in particular, to a cover which permits drainage of water from the upper surface of the cover via a drain and the filtering out of particulate contaminants in the drained water with a filter media selectively and removably positionable in alignment with the drain without removal of the cover.

2. Description of the Prior Art

While the present invention relates to swimming pools, fish ponds and similar water pools, the description which follows will be directed towards swimming pools with the understanding that the application may be made for similar fish pools or other similar water pools.

Covers for swimming pools are frequently required to prevent the ingress of dirt or waste material, such as fallen leaves, into the pool during the off season when the pool is not in use. The cover also serves to prevent or reduce evaporation of water and to further reduce thermal losses from the water particularly, again, in the off season when the pool is not in use.

Covers of flexible waterproof sheet material are the preferred method of covering a swimming pool, the cover extending beyond the periphery of the pool where it is secured. Covers of this type have the disadvantage in that they sag in their unsupported areas, normally the midpoint of the pool and therefore they tend to collect rain water, melted snow and other accumulated dirt, leaves, and debris during the period when the cover is in position. The pool owner must physically remove the particulate dirt, waste and debris from the cover and drain the accumulated water in order to prevent the bursting of the cover under the weight.

A partial solution to the problem was taught in U.S. Pat. No. 3,184,764 to West wherein a drain plug was positioned at the midpoint of the cover, which would coincide with the lowest point of the sag of the cover during the off season when the cover was in position. Over this drain, was positioned a mesh screen for the purpose of retaining leaves, paper, and other debris of a coarse or large nature. This allowed the accumulated water, either from rain or melted snow, to pass through the mesh, and through the drain hole and into the pool thereby alleviating the excess weight on the cover and preventing the bursting or tearing of the cover.

While the mesh screen of the '764 patent prevented coarse debris from entering into the pool, nevertheless, particulate matter, such as dirt or decaying leaf particulate, could pass through the mesh and through the drain hole into the pool presenting a cleaning problem in the springtime when the pool cover was removed.

U.S. Pat. No. 4,233,695 to Rowney attempted to present an answer to this problem by having a pocket formed over a mesh drain in the cover with the pocket having at least one aperture allowing water to pass through the aperture, and through the mesh drain. Positioned in the pocket between the aperture and the mesh drain would be a filter media in the form of a pad of a fibrous nature which would collect the particulate matter which might not have been trapped by the mesh screen as taught in the '764 patent.

The drawback to the solution proposed by Rowney in the '695 patent is that the filter media proposed by Rowney is fixed and thus can become impregnated with particulate matter to the point where it, in effect, plugs the drainage of the water or melting snow from the cover thereby preventing its drainage and increasing the weight and burden on the swimming pool cover. The pool owner's only solution in this situation is to remove the cover and replace the filter pad.

One of the most recent developments in an attempt to solve these problems is U.S. Pat. No. 5,259,078 to Crandall in which pockets are formed on the underside of the pool cover, and the pockets are lined with a filter material such that water is allowed to pass through the pool cover through a mesh opening in the pool cover, enter the pocket and pass through the filter material and into the pool. The pocket accumulates particulate matter as a result of the filter media lining. While this structure may eliminate the passage of small debris and particulate matter into the pool, it too cannot be cleaned or removed until the pool cover is removed as admitted by the inventor. Therefore, the possibility of the filter media becoming plugged and preventing the passage of water through the filter media into the pool becomes a possibility despite the fact that a plurality of such pockets could be formed about the lowermost portion of the pool cover.

Applicant has developed a swimming pool cover which allows for the drainage of water and melting snow from the cover into the pool, while at the same time, preventing the passage therethrough of coarse waste, such as paper, leaves and branches. At the same time, Applicant's swimming pool cover provides for a filter media which would also trap the small particulate debris, such as dirt or decaying leaf particulate. Applicant's filter media would be positioned in a sleeve which would intersect the drain port of the swimming pool cover and be slidably positionable within the sleeve. The filter media would be sized in excess of the size of the drain port and would allow the pool owner to slidably position the filter media in alignment with the drain port. In this configuration, the pool owner is able to position virgin filter media in alignment with the drain port and to slidably move this filter media out of alignment when it becomes impregnated to the point where it prevents the flow of water or melting snow through the drain port. By slidably repositioning the filter media, the pool owner moves the impregnated, contaminated portion of the filter media out of alignment with the drain port and out of the sleeve where it can be cleaned and reinserted or substituted with a new filter or alternatively simultaneously move a virgin filter media into alignment with the drain port while moving the contaminated filter media out of alignment. This procedure could be performed several times during the course of a closed season, when the pool cover is in position thereby obviating the need for removal of the pool cover to clean the filter media while at the same time ensuring that no particulate matter enters the pool.

OBJECTS OF THE INVENTION

An object of the present invention is to provide for a water pool cover which prevents the ingress of both coarse debris and particulate debris into the water pool while at the same time permitting the ingress of rain or melted snow which has accumulated on the water pool cover.

Another object of the present invention is to provide for a water pool cover which provides for the selective positioning of a filter media in alignment with a drain in the water pool cover to filter out and prevent the ingress of small particulate matter into the pool while at the same time permitting the ingress of rain and melted snow which has accumulated on the upper side of the pool cover.

A further object of the present invention is to provide for a novel water pool cover which provides a means by which the pool owner can effectively change the filter media without removing the pool cover from the water pool.

A still further object of the present invention is to provide for a novel water pool cover which prevents the ingress of coarse debris and particulate debris into the water pool while permitting the ingress of rain water or melting snow into the pool without contributing substantially to the weight of the water pool cover.

SUMMARY OF THE INVENTION

A cover for a water pool formed of flexible waterproof material having a drainage opening positioned therein, the cover having a sleeve defining a passageway secured on the cover and intersecting with the drainage opening, the passageway having a filter means slidably positionable within the passageway in selective alignment with the drainage means thereby allowing the pool owner to selectively present virgin filter media in alignment with the drainage means on successive occasions without the need for removal of the pool cover.

BRIEF DESCRIPTION OF THE DRAWINGS

These and other objects of the present invention will become evident, particularly when taken in view of the following drawings wherein.

DETAILED DESCRIPTION OF THE DRAWINGS

Figure 1:
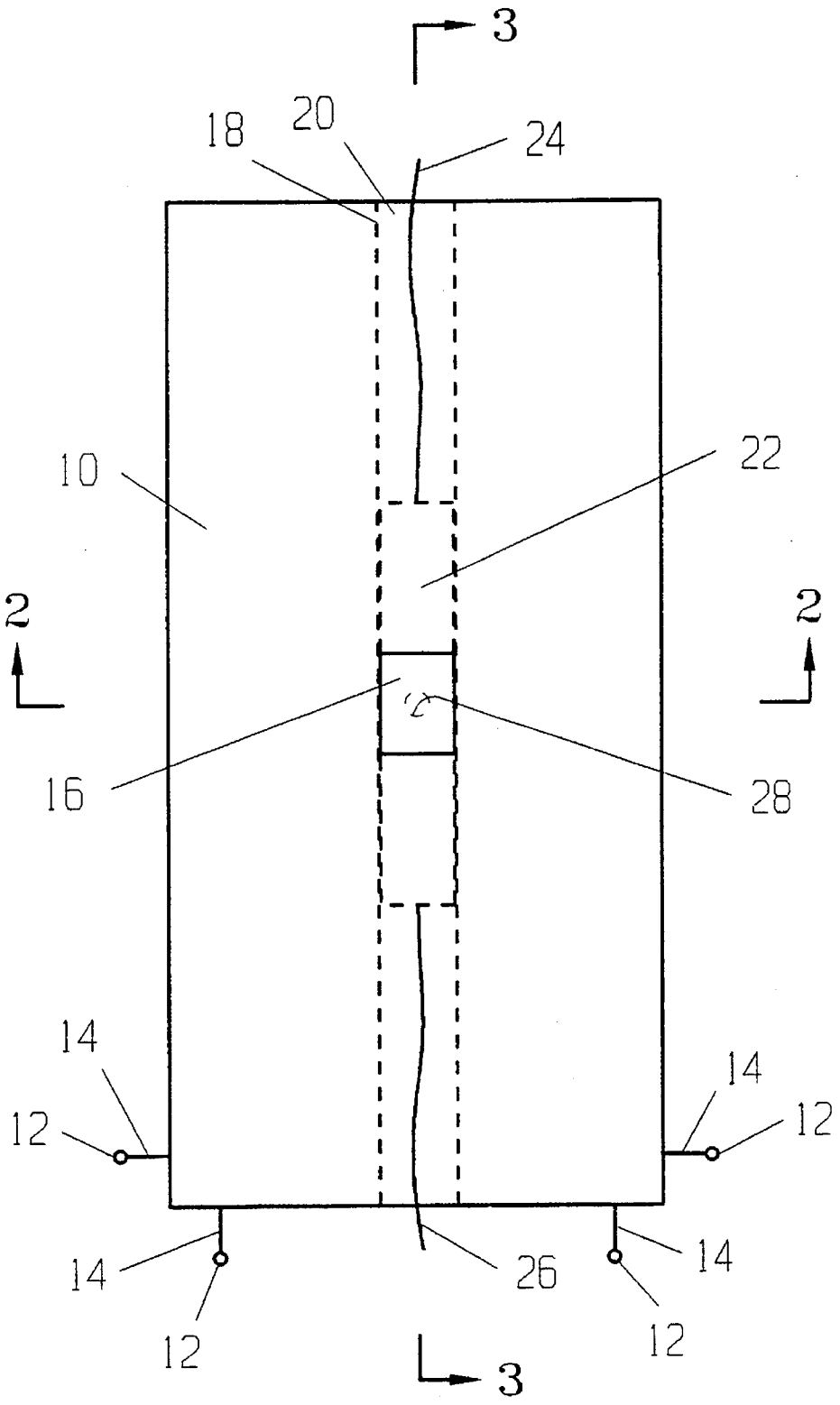
FIG. 1 is a top view of a pool cover positioned over a pool which is not shown.

FIG. 1 is a top view of a pool cover 10 which has been stretched taut about the periphery of a swimming pool. Cover 10 is held in place by a plurality of anchors 12 which are positioned in the decking about the pool periphery and which secure a series of strap and spring connectors 14 which are secured to the periphery of the pool cover 10. This anchoring means is disclosed in U.S. Pat. No. 5,259,078 to Crandall as well as Applicant's U.S. Pat. No. 5,421,041.

The pool cover utilized in illustrating and explaining Applicant's novel filter mechanism is generally rectangular in shape; however, the same concept would work for pools having a different geometric shape including pools having a generally arcuate periphery. It can also have application to large municipal pools or club pools which may require multiple drainage means and multiple sleeves and passageways as described hereinabove.

In the preferred embodiment, pool cover 10, which is constructed of a sheet of flexible, waterproof material or a plurality of sheets of flexible waterproof material sewn together, would have a centrally positioned drain means 16 formed on its surface. The drain means 16 would be positioned in cover 10 at a point or on an axis where the sag of the pool cover 10 would be greatest. On very large pools or free form pools, there may be more than one sag point which would require a corresponding drain means 16. Preferably, this drain means would be of a mesh structure to permit water or melting snow to pass therethrough while at the same time retaining coarse or large debris on the upper surface of pool cover 10. This coarse or large debris could generally be blown away by natural wind currents, but could be periodically removed by the pool owner with a broom.

Secured to the underside of pool cover 10, would be a sleeve 18. Sleeve 18 may be fashioned of flexible waterproof material. or of mesh material similar to drain means 16. Sleeve 18 could either be sewn to or heat sealed with pool cover 10 or secured by mechanical means such as a zipper and would define a passageway 20 which would extend between opposing edges of pool cover 10. Sleeve 18 and formed passageway 20 would be positioned so as to intersect with drainage means 18. Slidably positioned within sleeve 18 and passageway 20 would be a filter media 22 which would be dimensioned to fit snugly within passageway 20 yet still be slidably positioned within passageway 20 by means securing line 24 secured to one end of the filter media 22 and securing line 26 secured to the opposing end of filter media 22. A drain 28 would be positioned in sleeve 18, in alignment with the mesh drainage means 16 formed in cover 10 if sleeve 18 were fashioned of flexible waterproof material.

FIG. 1 illustrates a pool with one drain means 16 and one sleeve 18 and passageway 20. As stated previously, a large or irregular shaped pool may have more than one sag point. Therefore, sleeve 18 and passageway 20 may intersect more than one drain means 16 which are in alignment with each other or there may be a plurality of sleeves 18 and passageways 20 formed to intersect unaligned drain means 16.

Figure 2:
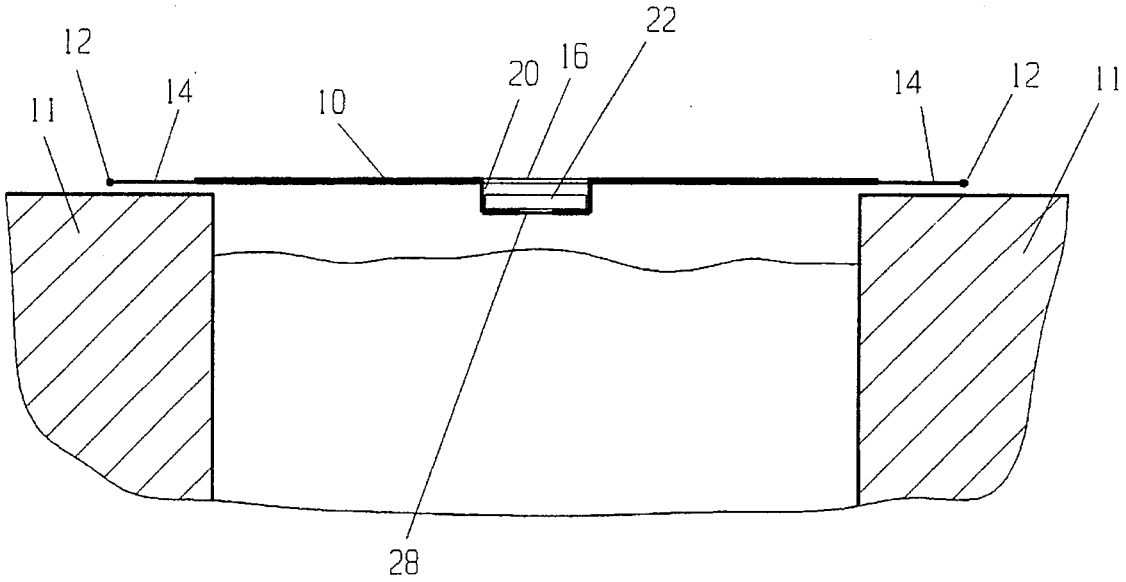
FIG. 2 is an end view of the pool cover illustrating the sleeve and filter media along axis 2—2 of FIG. 1.

FIG. 2 is a cross-sectional end view of pool cover 10 along axis 2—2 of FIG. 1. Pool cover 10 is positioned about the periphery of pool 11 by means of anchors 12 and securing means 14. Pool cover 10 is designed such that the mesh drainage means 16 is positioned over the pool area at its lowest sag point. It can be seen that sleeve 18 depends downwardly beneath cover 10 defining passageway 20 in which filter media 22 is slidably positioned. Drain 28 is formed in sleeve 18 to provide communication with the interior of pool 11. In this design, accumulated rain water or melting snow on the top of pool cover 10 is allowed to pass through the mesh drainage means 16. Mesh drainage means 16 prevents the passage therethrough of coarse or large debris, such as twigs, leaves or the like. The rain water or melting snow is then permitted to pass through filter media 22. Filter media 22 serves to collect and retain particulate matter, such as dirt, or decaying leaf particulate. The rain water or melting snow is then allowed to pass from the filter media through drain 28 and into pool 11. In this configuration, not only is large debris prevented from entering the pool interior, but also particulate matter is also prevented from entering the pool interior. Alternatively, sleeve 18 as illustrated in FIG. 2 can be fashioned of mesh material similar to that of drain means 16. This would eliminate the need for drain 28 in sleeve 18 since filtered water would pass through the mesh after having been filtered in filter media 22.

Figure 3:
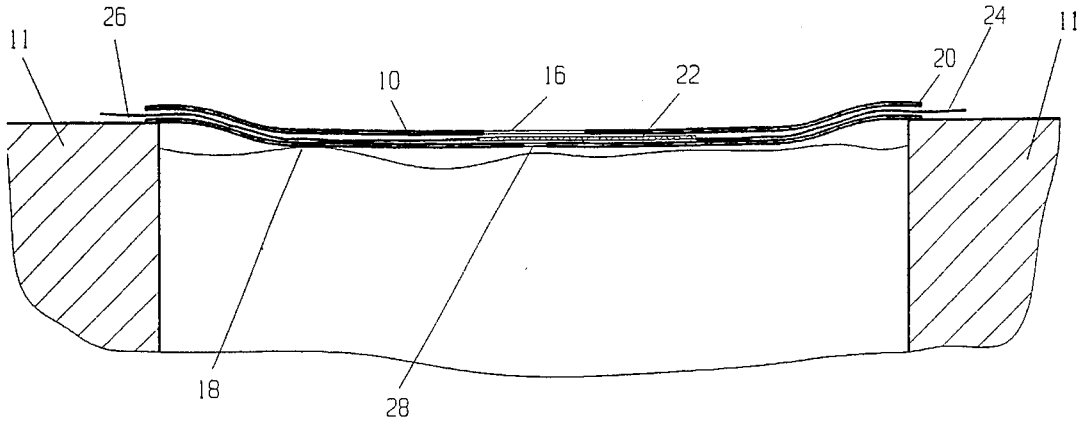
FIG. 3 is a side view of the pool cover illustrating the sleeve and filter media along axis 3—3 of FIG. 1.

FIG. 3 is a cross-sectional side view of pool cover 10 along axis 3—3 of FIG. 1. FIG. 3 illustrates the fact that under normal conditions, there will be a certain degree of sag in pool cover 10 and that this sag is anticipated in the construction of pool cover 10 so as to position mesh drain means 16 at a position that will proximate the lowest point of sag which would normally be the center of the pool area. FIG. 3 illustrates sleeve 18, cooperative with pool cover 10, forming passageway 20 which extends across pool cover 10. The drain 28 is formed in sleeve 18 in alignment with mesh drain means 16 on pool cover 10. Filter media 22 is positioned within passageway 20 and is slidably positionable therein by means of securing lines 24 and 26. Again, it will be noted that if sleeve 18 is fashioned of mesh material similar to drain means 16, then drain 28 can be eliminated from sleeve 18 for the reasons stated previously.

Filter media 22 has dimensions greater than the dimensions of mesh drain means 16 to ensure that all water passing through mesh drain means 16 must encounter and pass through filter media 22.

Figure 4A:
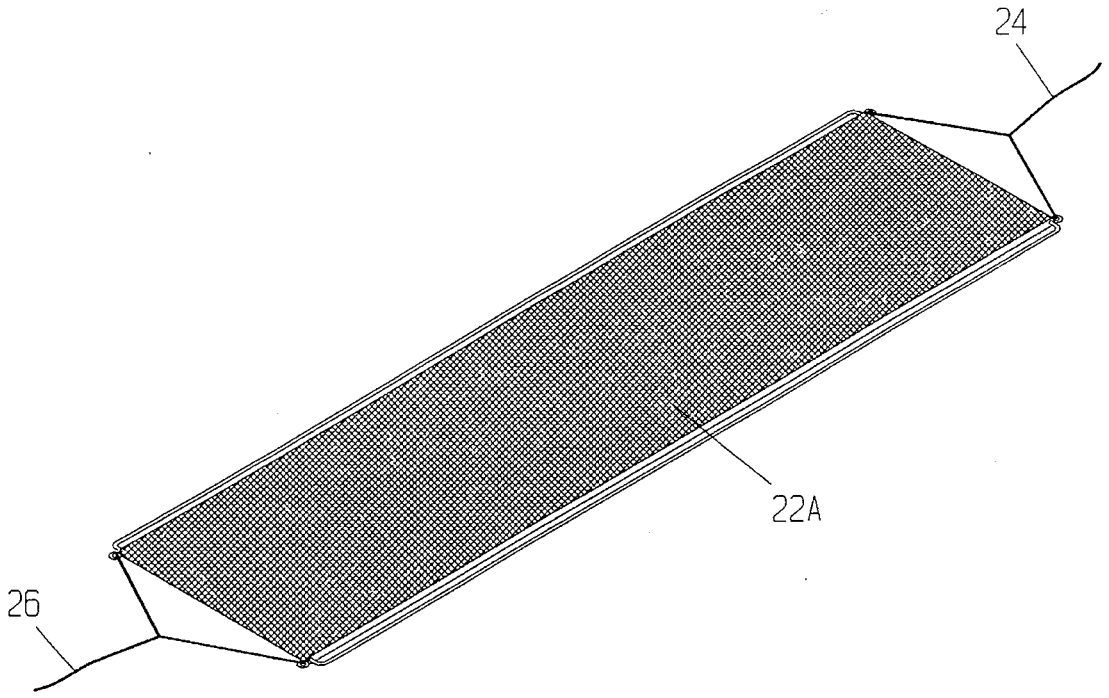
FIG. 4 is a perspective cross-sectional view of a second embodiment of the sleeve and filter media.

Filter media 22 may be either a non-woven filter or a woven filter or a laminated fabric filter of man-made fibers similar to that used for aquariums. The filtration capability of the filter can be varied from geographic area to geographic area depending upon the intensity and severity of the closed pool season when the cover 10 would be in place. Normally, to ensure adequate filtration of particulate matter, the pore size of the filter should not be greater than 300 microns. However, consideration must be given to allow adequate drainage of rain water and melting snow through the filter in order to ease the burden of this weight when it is retained above or on top of cover 10. Therefore, preferably, pore size should be in the range of 100 to 200 microns. If the filter is of a laminated fabric type material, it may have sufficient volume and thickness to be secured directly to the securing lines 24 and 26 without the need for a frame. FIG. 4A illustrates a perspective view of a filter of this type in which it has sufficient bulk and thickness such that filter 22A can be secured directly to securing lines 24 and 26 without the need for any form of frame. Filter media 22A, as illustrated in FIG. 4A, is dimensioned greater than the lateral dimension of drain means 16 and is dimensioned longitudinally by a factor of 2X, 3X, 4X . . . the longitudinal dimension of drain means 16. Filter media 22 A as illustrated in FIG. 4A is of a type that is designed to be positioned in sleeve 22 with one end in alignment with one edge of drain means 16, with filter media 22A being successively repositioned during the course of a season to allow a virgin portion of filter media 22A to come in alignment with drain means 16.

Figure 4B:
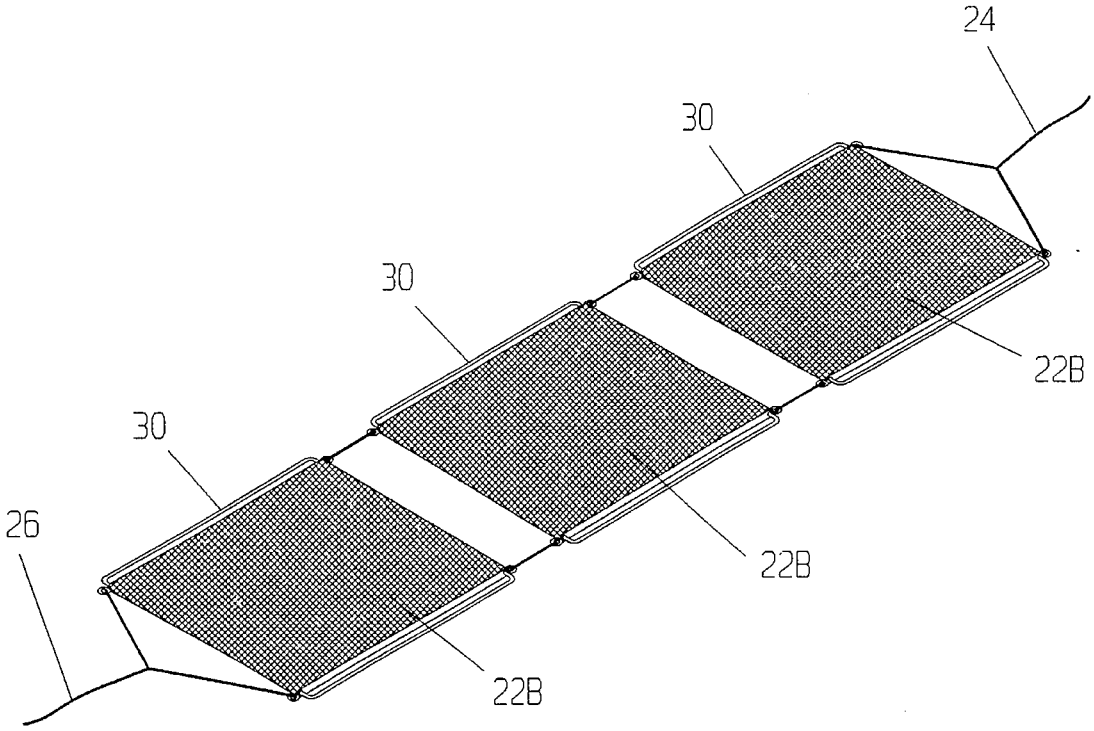
Figure 4C:
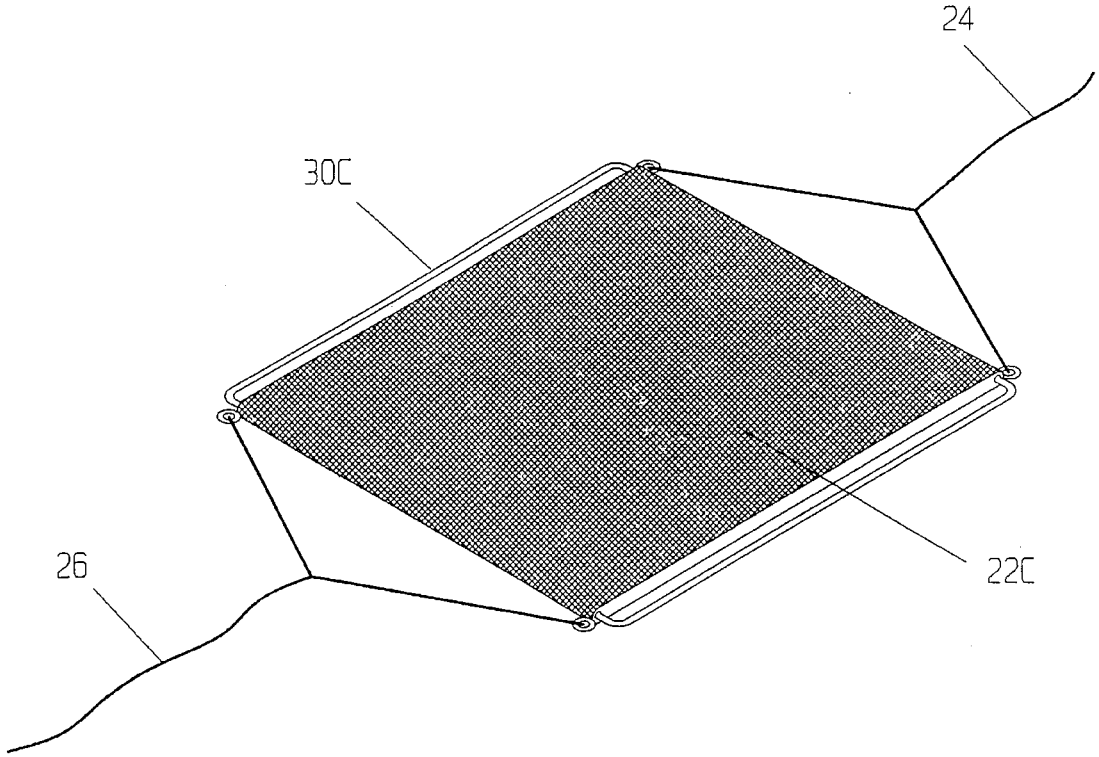

FIG. 4B illustrates yet another embodiment of filter media 22. If the filter is of a woven material, its thickness can be greatly reduced without depleting its filtration capacity. It may not be possible to attach such a filter directly to securing lines 24 and 26. FIG. 4B illustrates an embodiment wherein the woven or non-woven filtration media 22B are positioned within a frame 30 secured about the periphery. The dimension of frame 30 would be such to cause it to slide snugly within sleeve 18. FIG. 4B illustrates an embodiment wherein a plurality of filter media 22B, each of which is dimensioned greater than the dimensions of drain means 16, are secured within frames 30 and attached to each other in series. In this configuration, the accumulation of particulate matter and the depletion of filtration capability of the first aligned filter media 22B would cause the owner to slide the first filter media 22B out of alignment with drain means 16 and cause the second successive filter media 22B to be positioned in alignment with drain means 16. Again, this is accomplished by means of the manipulation of securing lines 24 and 26. This configuration allows the pool owner to successively change the filter without having to remove the filter or remove the cover of the pool. FIG. 4C illustrates the simplest embodiment of a slidable filter media 22 within sleeve 18. FIG. 4C illustrates a single filter media 22C, fabricated of woven or non-woven material positioned within frame 30C and having securing lines 24 and 26 secured to frame 30C. In this embodiment, filter media 22C is positioned in alignment with drain means 16. Upon the accumulation of particulate matter and the depletion of filtration capacity of filter media 22C, the owner would slidably remove filter media 22C and frame 30C from sleeve 18 and wash or rinse the filter media or, in the alternative, actually replace the filter media 22C within frame 30C and then slidably position filter media 22C again in alignment with drain means 16.

It can therefore be seen that depending upon the type of filter media utilized, the filter media may be secured within a frame or may be secured directly to the securing lines 24 and 26. The following description details the process when a filter media of the type 22A as illustrated in FIG. 4A is utilized within sleeve 18. It will be noted by those skilled in the art that the configurations illustrated in FIG. 4B and FIG. 4C can be positioned in the same manner depending upon the plurality of filter media secured in series arrangement.

Securing lines 24 and 26 permit the pool owner to slidably position an end portion of filter media 22 beneath mesh drain means 16 at the beginning of the closed season for the pool when the pool cover is installed. In this configuration, a portion of filter media 22 extends beneath the total area of mesh drain means 16 and above drain 28. Filter media 22 could be secured at this position by tying off securing lines 24 and 26 to a selective anchor 12 positioned about the pool deck or other suitable means.

As the season progressed with the accumulation of rain water, melting snow or the like, any large or coarse debris would be retained on the upper surface of pool cover 10 and not allowed to pass through mesh drain means 16. The rain water, melting snow and smaller particulate matter would pass through mesh drain means 16 and encounter filter media 22. Filter media 22 would retain the particulate debris and allow the clean rain water or melting snow to pass through to drain 28 and thence into pool 11.

At some point in time, the portion of filter media 22 positioned under mesh drain means 16 might become fully contaminated with particulate matter such that the flow of rain water or melting snow might be inhibited or that the filter media 22 was no longer capable of retaining any increase in volume of particulate matter. The pool owner would then unsecure securing lines 24 and 26 and slidably reposition filter media 22 within passageway 20 such that the portion of filter media 22 which had served as the filter media for the preceding time period and thus had become contaminated and impregnated with the particulate debris was moved out of alignment with mesh drain means 16 in cover 10 and a portion of filter media 22, which had not been exposed to the passage therethrough of rain water and melting snow, would be slidably positioned beneath mesh drain means 16. Securing lines 24 and 26 would then be resecured and a virgin area of filter media 22 would then be positioned between the mesh drain means 16 and drain 28 to collect and retain particulate matter which might pass through mesh drain means 16.

The aforesaid procedure could be repeated on several occasions during the course of the closed season for the pool 11 when pool cover 10 was in position. It will be recognized that the number of times which the procedure could be accomplished would be limited to the ratio of the longitudinal length of the filter media positioned in passageway 20 at the time the pool cover 10 was placed in position, to the longitudinal dimension of mesh drain means 16.

In severe situations, it would also be possible to remove the filter media 22 which was originally positioned in passageway 20 when pool cover 10 was positioned over the pool with a completely new filter media simply by attaching one securing line 24 of the new filter media to a securing line of the old filter media and then pulling the opposing securing line of the old filter media so as to remove the old filter media and slidably position new filter media within passageway 20. All of this can be accomplished without removal of the pool cover which would have been required with respect to the teachings of the prior art.

Figure 5:
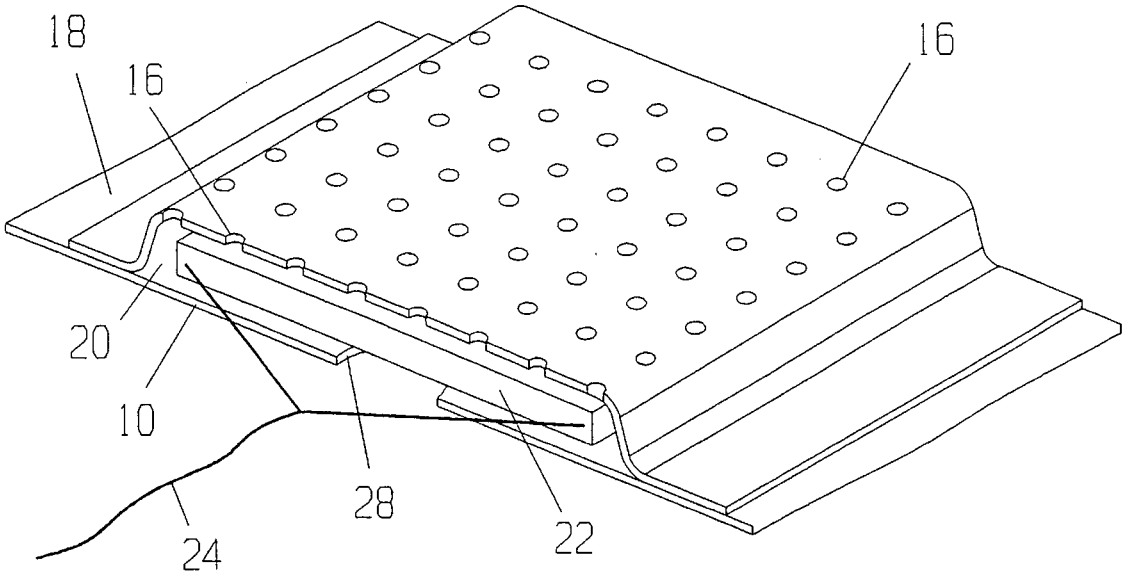
FIG. 5 is a partial cutaway view of the sleeve and filter media of the second embodiment.

While the preferred embodiment of the present invention has been described with respect to the sleeve 18 and passageway 20 being formed and secured to the underside of pool cover 10, it would be possible to have the sleeve 18 and defined passageway 20 positioned on the upper surface of pool cover 10 as illustrated in FIG. 5 which is a cross-sectional, perspective view of sleeve 18, passageway 20 and filter media 22. While this second embodiment would perform in the same manner, the fact that the filter media 22 would be positioned within passageway 20 would cause the sleeve 18 to be slightly elevated at its lowermost portion or sag point and would therefore interfere with the complete drainage of rain water and melting snow from the upper surface of pool cover 10.

Nevertheless, the second embodiment would still ensure that the rain water and melting snow passing through the mesh drain portion 16 which would now be formed in sleeve 18 and through drain 28 which would now be formed in pool cover 10 would still be contaminant free from small particulate matter which had been collected and retained by filter media 22. In the second embodiment illustrated in FIG. 5 in which the sleeve is positioned on the upper side of the cover, the mesh drain means 16 would be formed on sleeve 18 as illustrated and would be positioned on sleeve 18 at a lowermost sag point of cover 10. Filter media 22 would be positioned within passageway 20 and in this instance, since cover 10 is made of flexible waterproof material, a drain opening 28 would be formed in cover 10 in alignment with mesh drain means 16 formed on sleeve 18. Alternatively, a drain opening could be formed in cover 10 similar to mesh drain opening 16 in sleeve 18 in this embodiment. The two, being alignable, to permit the passage of rain water and melting snow from the top of cover 10 through mesh drain means 16 in sleeve 18, through filter media 22 and through the mesh drain in cover 10 and hence into the pool. FIG. 5 further illustrates the snugness with which the filter media 22 is designed to fit within passageway 20.

The swimming pool cover which is the subject of the present invention has been described and illustrated thus far with respect to regular standardized pools of a rectangular or square nature commonly found in a residence situation which would have dimensions anywhere in the neighborhood of 16 to 25 feet in width and 30 to 48 feet in width. Swimming pools often found in residence situations can also be free-form, having a completely arcuate periphery. Additionally, certain pools found in municipal situations or in swim club situations are normally much larger than those found in a residence and approach Olympic size dimensions in order to permit the conducting of swim meets. For illustrative purposes showing the application of Applicant's pool cover to large municipal or swim club pools and free-formed pools having arcuate periphery, FIGS. 6 and 7 are included.

Figure 6:
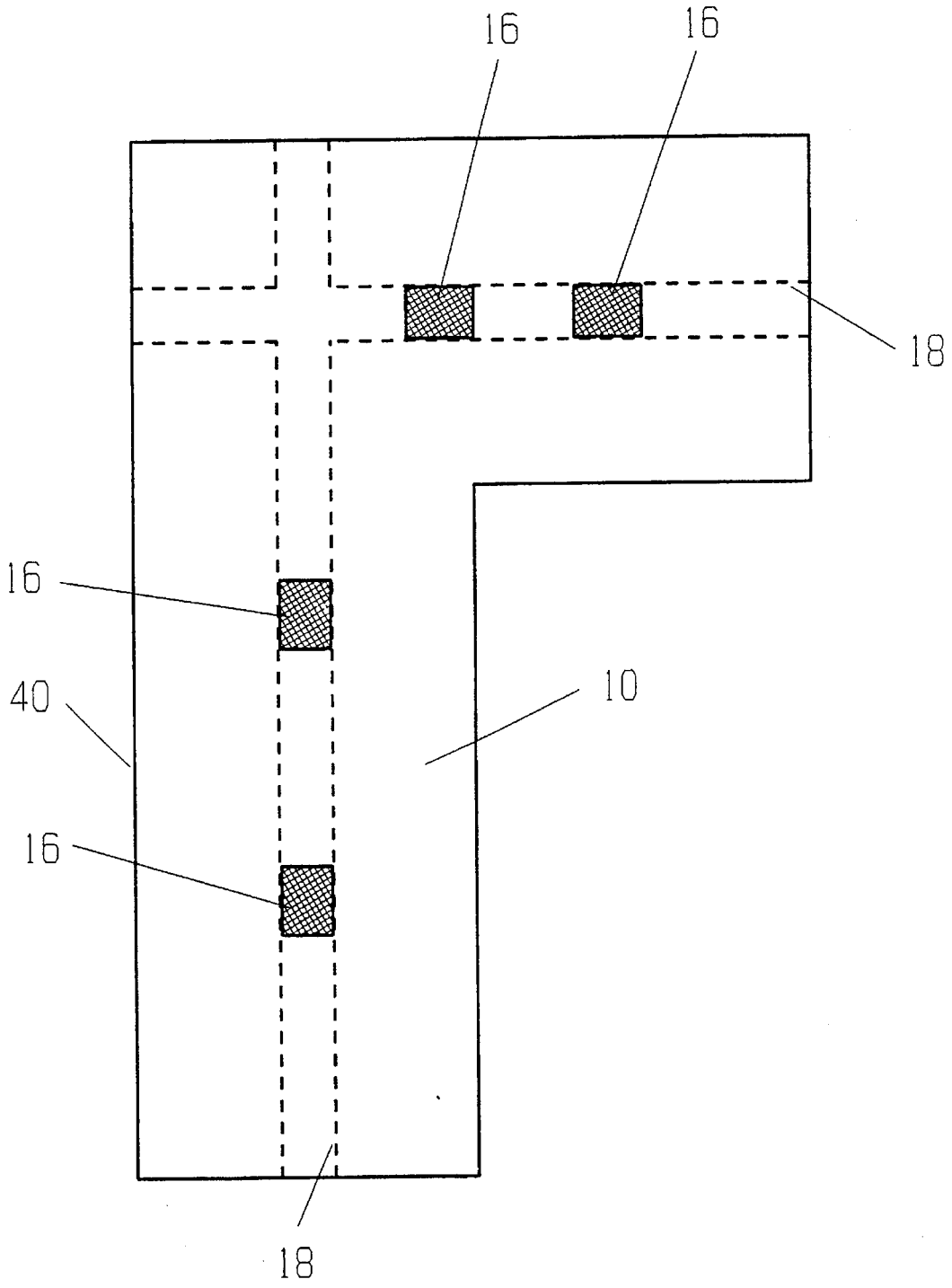
FIG. 6 is a top view of the pool cover placed over a typical municipal swimming pool.

FIG. 6 represents a top view of what could be considered to be a large municipal swim club pool generally L-shaped in nature having a first leg 40, generally rectangular and suitable for establishing swim lanes for swim meets therein and probably approximating fifty meters in length. Second leg 42 may be shorter than leg 40 and be designed to accommodate a diving area. In providing a cover for this pool, it would be necessary to have multiple mesh drain means 16 in order to accommodate the large amount of rain water or melting snow which might accumulate on this cover. Further, due to the size of the cover, there would normally not be one individual sag point at which the mesh drain means 16 could be located. FIG. 6 illustrates one manner of accomplishing the removal of accumulated rain water and melting snow from a cover of this type using Applicant's invention.

A first sleeve 18 would run the longitudinal axis length of leg 40 and intersect multiple mesh drain means 16, which in this instance, as illustrated consists of two mesh drain means in alignment. This is done because a pool of this nature would more than likely provide a longitudinal sag point along leg 40 at the midpoint of leg 40. However, leg 42 would also present sag points and a second sleeve 18 would run the longitudinal axis of leg 42 and intersect one or more mesh drain means 16 in alignment with the axis sag that would occur along this leg. In this configuration, the pool cover can be drained during the off season with two intersecting sleeves 18 which will not interfere with the filter media 22 positioned in each separate sleeve. It is a simple matter to provide the filter media with interconnecting tether lines or securing lines so that the filter media 22 can be simultaneously positioned under the plurality of mesh drain means intersecting the first sleeve 18 in leg 40 as well as having multiple filter media 22 positioned and distanced so as to be capable of being positioned under multiple mesh drain means 16 in second sleeve 18 along leg 42. In all other respects, the operation of the filter media as previously discussed would be the same.

Figure 7:
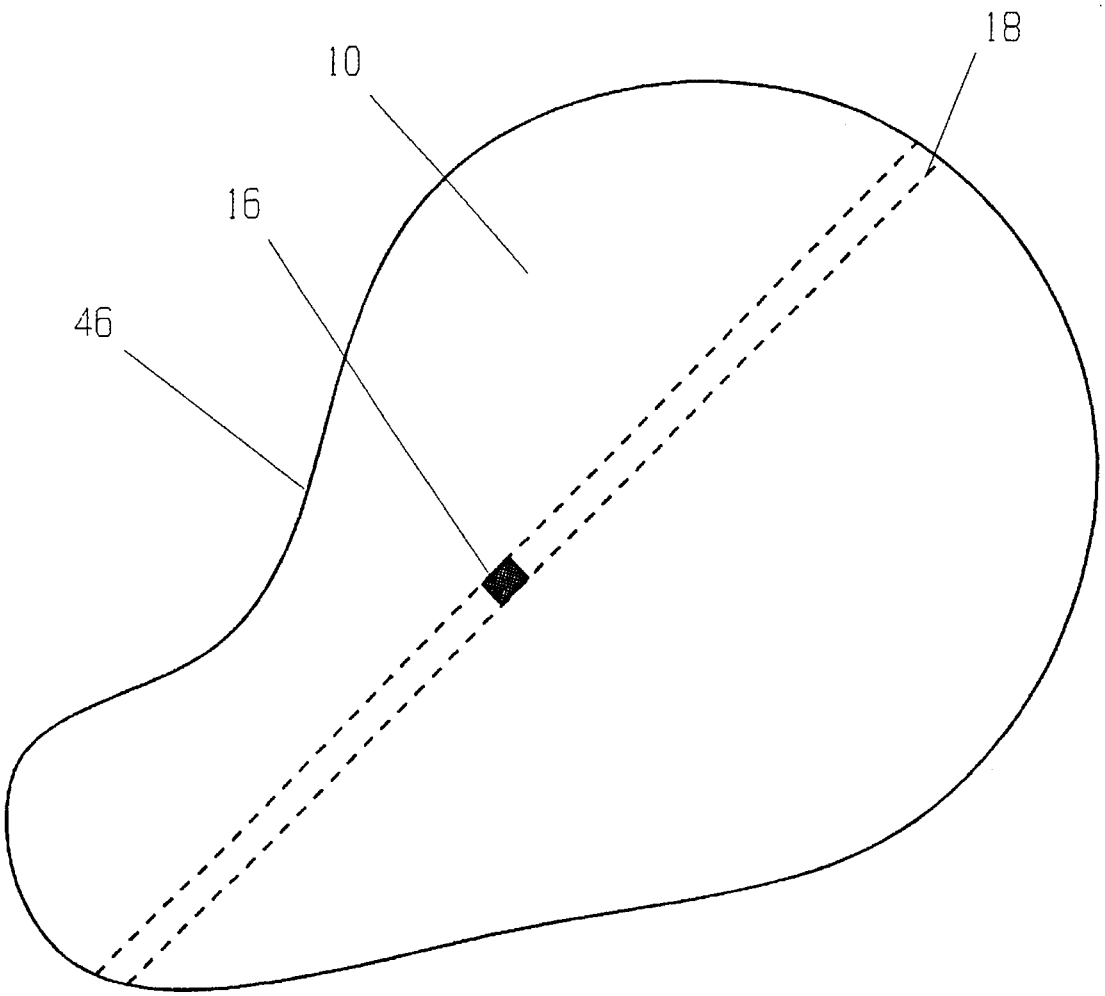
FIG. 7 is a top view of the pool cover placed over a pool having an arcuate periphery.

FIG. 7 illustrates a free-form pool having an arcuate periphery 46. While previous examples of Applicant's pool cover 10 have dealt with pools having straight edge peripheries with the sleeve 18 and passageway 20 passing perpendicularly from one edge of the pool cover to the other, it is quite common to have pool covers fabricated for pools having an arcuate periphery as illustrated in FIG. 7. In this instance, the same steps are taken to ensure that the pool cover, when in position, is drained of rain water and melting snow. Mesh drain means 16 is fabricated into the pool cover 10 at a point approximating the maximum sag point. The sleeve 18 is designed to intersect mesh drain means 16 and, as illustrated in FIG. 7, sleeve 18 need not run from one parallel sidewall to another parallel sidewall, but can be fabricated in cover 10 so as to accommodate the needs of free-form pools having an arcuate periphery.

Figure 8:
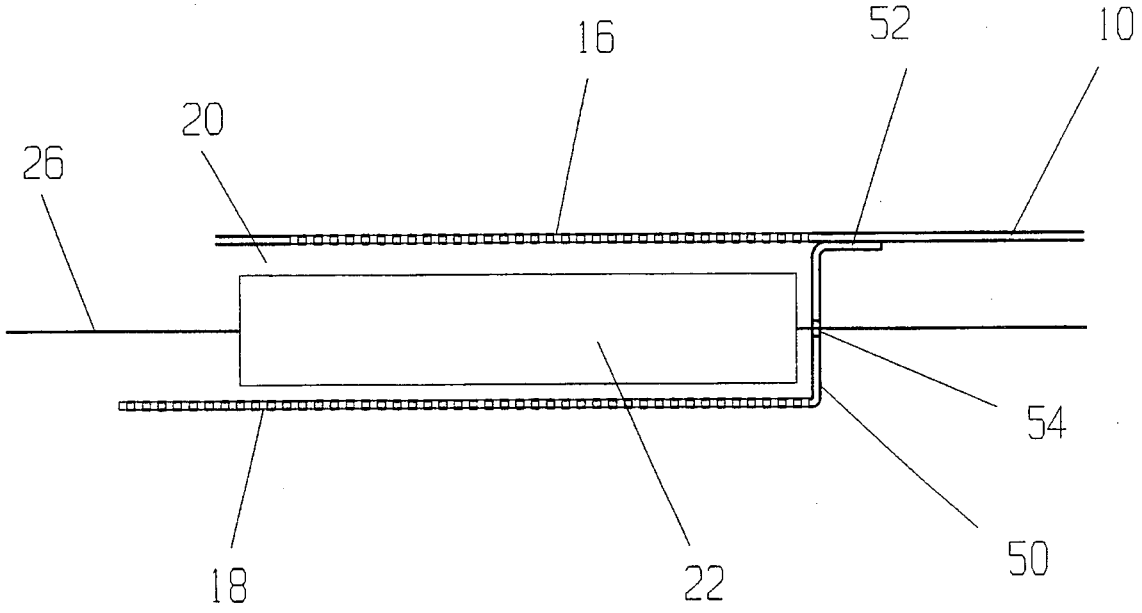
FIG. 8 is a partial cutaway side view illustrating a further embodiment of the invention.

FIG. 8 illustrates one further embodiment of pool cover 10. FIG. 8 is a partial cutaway side view illustrating a still further embodiment for positioning filter media 22 in alignment with the drain means for pool cover 10.

In FIG. 8, pool cover 10 is positioned over the pool (not shown) with mesh drain means 16 positioned at the lowest sag point of cover 10. Sleeve 18 is secured to the underside of cover 10 forming passageway 20. It will be noted that in FIG. 8, sleeve 18 is constructed of a mesh material similar to mesh drain means 16 as opposed to it alternatively being fabricated of a resilient waterproof material having a drain hole in alignment with mesh drain means 16. In the embodiment illustrated in FIG. 8, instead of passageway 20 extending from one edge of cover 10 to an opposing edge, passageway 20 terminates at an end wall 50 formed of sleeve 18 being resecured to cover 10 by a seam or thermowelding at point 52. End wall 50 has an aperture 54 therethrough to accommodate a securing line 24 or 26 attached to filter media 22. The filter media illustrated in FIG. 8 would be the equivalent of the filter media illustrated in FIG. 4C, namely, a single filter media removable periodically for flushing, cleaning, or replacement during the closed season.

In this configuration, it can be seen that prior to the pool cover 10 being placed over the pool, filter media 22 would be fed into passageway 20 and one of the guidelines, either 24 or 26, would be passed through opening 54 and end wall 50. The pool cover would then be spread about the pool and secured in position. Guideline 24 would then be pulled taut so as to bring filter media 22 through passageway 20 until it contacted end wall 50 at which point its movement would be terminated. End wall 50 in effect serves to guarantee the alignment of filter media 22 with mesh drain means 16.

During the closed season, if filter media 22 was required to be cleaned or changed, it would merely be withdrawn from passageway 20 using guideline 26 with the understanding that guideline 24 would be of sufficient length not to pass under cover 10 and into the pool and be lost. The filter media could be cleaned or changed and then drawn back into passageway 20 by means of guideline 24, until it contacted end wall 50 at which point its location under drain means 16 would be ensured.

While the embodiment disclosed in FIG. 8 has been discussed and illustrated with respect to a single filter media 22, similar to that disclosed in FIG. 4C, the positioning of end wall 50 of sleeve 18 may be varied in order to accommodate the filter media disclosed in FIGS. 4B and 4A without departing from the intent of end wall 50 to ensure the positioning of the filter media in the appropriate location. It will be recognized by those skilled in the art that the design of sleeve 18 with end wall 50 as illustrated in FIG. 8 will be of particular benefit to covers in which sleeve 18 and passageway 20 intersect only one drain means 16. Where multiple drain means 16 are intersected by the same sleeve 18 and define passageway 20, the use of the embodiment illustrated in FIG. 8, with end wall 50, would be prohibitive.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. A cover for a water pool comprising:

a sheet of flexible, waterproof material having a drainage opening positioned therein, said sheet of flexible, waterproof material adapted to be secured about the periphery of said water pool;

a sleeve defining a passageway secured on said sheet of flexible, waterproof material, said sleeve defining a passageway in alignment with and intersecting said drainage opening;

a filter means slidably positionable in said sleeve defining said passageway, said filter means having a planar area dimension greater than the planar area dimension of said drainage opening, said filter means permitting the passage of water therethrough, said filter means preventing the passage of particulate matter therethrough by accumulation of said particulate matter in said filter means;

a means for slidably positioning said filter means within said sleeve in registration with said drainage opening; said means for slidably positioning comprising a pair of opposing tether lines secured to opposing sides of said filter means and extending outwardly in said sleeve defining said passageway to a periphery of said sheet.

2. The cover for a water pool in accordance with claim 1 wherein said drainage opening positioned in said sheet of flexible, waterproof material is comprised of a mesh material for permitting the passage of water therethrough, but preventing the passage therethrough of coarse material and large debris.

3. The cover for a water pool in accordance with claim 1 wherein said sleeve, defining said passageway, is comprised of a mesh material to allow the passage of water therethrough.

4. The cover for a water pool in accordance with claim 1 wherein said sleeve, defining said passageway, is comprised of flexible, waterproof material having a drain positioned therein, said drain in alignment with said drain opening in said cover comprised of said sheet of flexible, waterproof material.

5. The cover for a water pool in accordance with claim 1 wherein said sleeve, defining said passageway, extends from one side of a periphery of said sheet to an opposing side of said periphery of said sheet, intersecting said drainage opening in said flexible, waterproof material.

6. The cover for a water pool in accordance with claim 1 wherein said sleeve, defining said passageway, extends from one side of a periphery of said sheet to a point beyond said drainage opening in said sheet of flexible, waterproof material, but short of an opposing side of said periphery of said sheet, said sleeve terminating in an end wall having an aperture therethrough.

7. The cover for a water pool in accordance with claim 1 wherein said filter means comprises a filter media having a sized planar area greater than said planar area of said drainage opening in said sheet of flexible waterproof material, said filter media having a means for slidably positioning said filter media within said sleeve, said means for slidably positioning said filter media comprising tether lines secured to opposing sides of said filter media and extending outwardly in said sleeve defining said passageway, to a periphery of said sheet.

8. A cover for a water pool in accordance with claim 7 wherein said filter means comprises a single filter media having a planar area dimensioned slightly larger than said drainage opening in said sheet of flexible, waterproof material.

9. The cover for a water pool in accordance with claim 7 wherein said filter means comprises a plurality of filter media secured in series, each of said filter media having a planar area dimensioned greater than the planar area of said drainage opening in said sheet of flexible, waterproof material.

10. The cover for a water pool in accordance with claim 7 wherein said filter means comprises a one-piece filter media having a lateral dimension greater than the lateral dimension of said drainage opening in said sheet of flexible, waterproof material and a longitudinal dimension greater than the longitudinal dimension of said drainage opening in said sheet of flexible, waterproof material so as to permit successive areas of said filter media to be slidably aligned and registered with said drainage opening in said sheet of flexible, waterproof material.

11. The cover for a water pool in accordance with claim 7 wherein said filter means comprises a filter media of woven material secured within a peripheral frame, slidably positionable within said sleeve defining said passageway in said sheet of flexible, waterproof material.

12. The cover for a water pool in accordance with claim 7 wherein said filter means comprises a filter media having pore sizes not greater than about 300 microns.

13. The cover for a water pool in accordance with claim 7 wherein said filter means comprises a filter media having pore sizes between 100 and 300 microns.

14. The cover for a water pool in accordance with claim 1 wherein said sleeve, defining said passageway on said cover, is positioned on the underside of said cover.

15. The cover for a water pool in accordance with claim 1 wherein sleeve, defining said passageway, is positioned on said upper side of said cover.

16. The cover for a water pool in accordance with claim 1 wherein said sheet of flexible, waterproof material has a plurality of drain openings positioned therein and a plurality of sleeves defining passageways formed on said sheet of flexible, waterproof material and intersecting said drainage openings.

17. A method for removing water from the upper surface of a flexible, waterproof cover for a water pool and preventing the ingress of contaminant particulate matter into the water pool on a continuous basis without the removal of the cover, the method comprising:

(a) forming a drain opening on said cover at a point proximate to its maximum sag point;

(b) securing a sleeve defining a passageway on said cover in alignment with and intersecting said drain opening, said sleeve defining said passageway having formed therein, a second drain means;

(c) slidably positioning a filter means in said sleeve defining said passageway, said filter means having a planar area dimensioned greater than the planar area dimension of said drainage opening in said cover, said filter means permitting the passage of water therethrough, said filter means preventing the passage of particulate matter therethrough by accumulation of said particulate matter in said filter means; said filter means having tether lines secured thereto and extending outwardly in said sleeve to the periphery of said cover.

(d) positioning said cover for said water pool over said water pool such that said cover extends beyond the periphery of said water pool;

(e) securing said cover in position;

(f) slidably positioning said filter means in registration with said drain opening in said cover;

(g) slidably removing said filter means for cleaning;

(h) repeating steps f and g as required.

18. The method in accordance with claim 17 wherein said filter means has a longitudinal length greater than said drain opening in said cover thereby permitting the slidable positioning of clean filter means in registration with said drain opening in said cover pursuant to step (f) without requiring removal of said filter means pursuant to step (g).

* * * * *